US010500638B2

(12) United States Patent
Ito et al.

(10) Patent No.: US 10,500,638 B2
(45) Date of Patent: Dec. 10, 2019

(54) LUBRICANT, MIXED POWDER FOR POWDER METALLURGY, AND METHOD FOR PRODUCING SINTERED BODY

(71) Applicant: Kobe Steel Ltd., Kobe-shi (JP)

(72) Inventors: Yoshihiro Ito, Kobe (JP); Eiichiro Yoshikawa, Kobe (JP); Nobuaki Akagi, Takasago (JP); Yuji Taniguchi, Takasago (JP); Mitsuhiro Sato, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 245 days.

(21) Appl. No.: 15/520,463

(22) PCT Filed: Dec. 1, 2015

(86) PCT No.: PCT/JP2015/083814

§ 371 (c)(1),
(2) Date: Apr. 20, 2017

(87) PCT Pub. No.: WO2016/104077

PCT Pub. Date: Jun. 30, 2016

(65) Prior Publication Data

US 2017/0304893 A1 Oct. 26, 2017

(30) Foreign Application Priority Data

Dec. 26, 2014 (JP) ..... 2014-266266

(51) Int. Cl.
*B22F 1/00* (2006.01)
*B22F 1/02* (2006.01)
*B22F 3/10* (2006.01)

(52) U.S. Cl.
CPC ..... *B22F 1/0062* (2013.01); *B22F 1/0011* (2013.01); *B22F 1/02* (2013.01);
(Continued)

(58) Field of Classification Search
CPC ..... B22F 1/0062; B22F 1/0011; B22F 1/02; B22F 3/10; B22F 2301/35; B22F 2302/40
See application file for complete search history.

(56) References Cited

U.S. PATENT DOCUMENTS 9,844,811 B2 * 12/2017 Nakai ..... C10M 105/70
10,240,032 B2 * 3/2019 Ito ..... C22C 38/00
(Continued)

FOREIGN PATENT DOCUMENTS

EP 2 207 408 A1 7/2010
EP 2 636 724 A1 9/2013
(Continued)

OTHER PUBLICATIONS

International Search Report dated Feb. 23, 2016, in PCT/JP2015/083814, filed Dec. 1, 2015.
(Continued)

*Primary Examiner* — Kevin E Yoon
*Assistant Examiner* — Ryan L Heckman
(74) *Attorney, Agent, or Firm* — Oblon, McClelland, Maier & Neustadt, L.L.P.

(57) ABSTRACT

One aspect of the present invention is a lubricant to be incorporated into a powder metallurgical mixed powder containing an iron-based powder. The lubricant includes a flaky organic material having an average particle diameter of from 0.1 μm to less than 3 μm. Another aspect of the present invention is a powder metallurgical mixed powder which contains an iron-based powder and the lubricant. Yet another aspect of the present invention is a method for producing a sintered compact. The method includes the step of mixing materials to give a powder metallurgical mixed powder containing an iron-based powder and the lubricant. The powder metallurgical mixed powder is compacted using a
(Continued)

die to give a powder compact. The powder compact is sintered to give a sintered compact.

10 Claims, 1 Drawing Sheet

(52) U.S. Cl.
CPC ..... *B22F 3/10* (2013.01); *B22F 2301/35* (2013.01); *B22F 2302/40* (2013.01)

(56) References Cited

U.S. PATENT DOCUMENTS

| | | | | |
|---|---|---|---|---|
| 2001/0028859 | A1 | 10/2001 | Ozaki et al. | |
| 2010/0264357 | A1 | 10/2010 | Aramaki et al. | |
| 2014/0038865 | A1* | 2/2014 | Shimura | C10M 169/04 508/256 |
| 2015/0283609 | A1 | 10/2015 | Nakai et al. | |
| 2015/0361255 | A1 | 12/2015 | Ito et al. | |
| 2016/0244690 | A1 | 8/2016 | Shimura et al. | |

FOREIGN PATENT DOCUMENTS

| | | | |
|---|---|---|---|
| JP | 2-204355 | A | 8/1990 |
| JP | 10-317001 | | 12/1998 |
| JP | 2001-181665 | A | 7/2001 |
| JP | 2005-154511 | A | 6/2005 |
| JP | 2006-335876 | A | 12/2006 |
| JP | 2013-87328 | A | 5/2013 |
| JP | 2014-118603 | A | 6/2014 |
| JP | 2014-196553 | A | 10/2014 |
| JP | 6437309 | B2 | 12/2018 |
| WO | WO 2014/097871 | A1 | 6/2014 |

OTHER PUBLICATIONS

Extended European Search Report dated Jun. 5, 2018 in European Patent Application No. 15872646.3, 10 pages.

Shimamoto, H. "Certificates of Experiment Results" JFE Steel Sheet Co., Ltd., Steel Research Laboratory, Iron Powder and Magnetic Materials Research Department, 2019, 5 pages (with English translation).

* cited by examiner

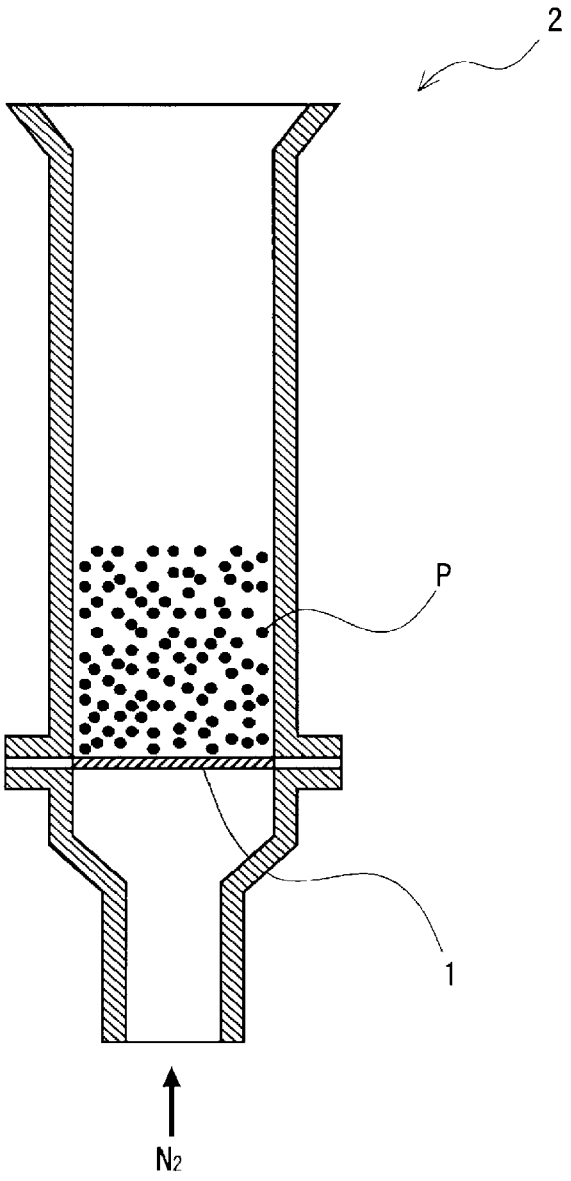
2
P
1
N2

LUBRICANT, MIXED POWDER FOR POWDER METALLURGY, AND METHOD FOR PRODUCING SINTERED BODY

TECHNICAL FIELD

Powder metallurgy processes have been known as a method for producing a sintered compact using an iron-based powder. In general, the powder metallurgy processes include a mixing step, a compacting step, and a sintering step. In the mixing step, an iron-based powder is mixed with one or more other optional components such as an auxiliary material powder to give a mixed powder for powder metallurgy (powder metallurgical mixed powder). In the compacting step, the resulting powder metallurgical mixed powder is compacted using a die to give a powder compact. In the sintering step, the powder compact is sintered at a temperature equal to or lower than the melting point of the iron-based powder.

In the compacting step, the powder compact obtained by compaction using a die is ejected from the die. In the mixing step, a lubricant is incorporated into the powder metallurgical mixed powder. The lubricant is added so as to reduce friction between the powder compact and the die upon ejection of the powder compact from the die in the compacting step, and so as to allow the powder metallurgical mixed powder to have better flowability. Generally used examples of the lubricant include metal soaps such as zinc stearate; and amide lubricants such as ethylenebis(stearamide).

On the other hand, the powder metallurgical mixed powder is often combined with graphite as an auxiliary material powder for higher strength. Graphite, however, has a smaller specific gravity and a smaller particle diameter as compared with the iron-based powder. The graphite is therefore significantly separated from the iron-based powder and is segregated when the iron-based powder and the graphite are merely mixed. Thus, uniform mixing may be impeded when the iron-based powder is merely mixed with graphite or another auxiliary material powder differing in specific gravity from the iron-based powder.

Independently, incorporation of a binder into the powder metallurgical mixed powder has also been proposed. The presence of the binder in the mixture may probably restrain the segregation of the auxiliary material powder such as graphite. This may probably enable uniform mixing and may allow the powder metallurgical mixed powder to have better uniformity even when an auxiliary material powder such as graphite is mixed. Disadvantageously, however, such a binder has high tackiness, may adversely affect the flowability of the powder metallurgical mixed powder, and, consequently, may impede preparation of a homogeneous powder compact.

An example of powder metallurgical mixed powders containing one or more components in addition to an iron-based powder is the power disclosed in Patent Literature (PTL) 1.

PTL 1 describes an iron-based component, a flowability-improver, and melamine cyanurate. The binding agent at least partially adheres to the surface of the iron powder. The alloy component at least partially adheres to the binding agent adhering to the surface of the iron powder. The flowability-improver at least partially adheres to the iron powder. The melamine cyanurate is at least partially liberated from the iron powder.

PTL 1 discloses that the resulting iron-based powder for powder metallurgy has excellent ejectability (drawability); and that the excellent ejectability is obtained because melamine cyanurate preferentially adheres to the die wall, and this eliminates or minimizes direct contact between and galling of the die and the iron powder upon compaction and upon ejection.

CITATION LIST

Patent Literature

PTL 1; Japanese Unexamined Patent Application Publication (JP-A) No. 2013-87328

SUMMARY OF INVENTION

The present invention has been made under these circumstances and has an object to provide a lubricant that allows a powder metallurgical mixed powder to offer better flowability and to give a high-density sintered compact. The present invention has another object to provide a powder metallurgical mixed powder containing the lubricant; and to provide a method for producing a sintered compact using the lubricant.

The present invention provides, in an aspect, a lubricant to be incorporated into a powder metallurgical mixed powder containing an iron-based powder. The lubricant includes a flaky organic material having an average particle diameter of from 0.1 μm to less than 3 μm.

The above and other objects, features, and advantages of the present invention will become dearer from the following detailed description when taken in conjunction with the accompanying drawing.

BRIEF DESCRIPTION OF DRAWINGS

FIG. 1 is a schematic crass-sectional view of a graphite scattering rate measuring device used in working examples.

DESCRIPTION OF EMBODIMENTS

After intensive investigations, the inventors of the present invention found that a sintered compact, when produced using an iron-based powder for powder metallurgy containing melamine cyanurate, as described in PTL 1, may fail to have a sufficiently high density and may fail to be a high-quality sintered compact. The inventors also found that the density of the sintered compact is reduced because part of melamine cyanurate which does not adhere to the die inner wall acts as a foreign substance, enters between powders such as iron powders, and impedes the compaction of the powder metallurgical mixed powder. PTL1 mentions that melamine cyanurate preferably has an average particle diameter of 3 to 20 μm. The inventors found that melamine cyanurate having a particle diameter within this range, when used, often fails to allow the resulting sintered compact to have a sufficiently high density and to be a high-quality sintered compact, as described above.

In consideration of these, the inventors have focused attention on a lubricant containing a flaky organic material such as melamine cyanurate and further have focused attention on the average particle diameter of the flaky organic material. The present invention has been made on the basis of these.

Some embodiments according to the present invention will be illustrated below. It should be noted, however, these embodiments are never construed to limit the scope of the present invention.

First Embodiment

Lubricant

A lubricant according to an embodiment of the present invention is a lubricant to be incorporated into a powder metallurgical mixed powder containing an iron-based powder. The lubricant includes a flaky organic material having an average particle diameter of from 0.1 μm to less than 3 μm. Specifically, the lubricant is incorporated into a powder metallurgical mixed powder containing an iron-based powder. The lubricant, as incorporated into the powder metallurgical mixed powder, is present in gaps (space) typically between particles of powders such as iron-based powders and allow these powders to have better lubricity. Namely, the presence of the lubricant gives a powder metallurgical mixed powder having excellent flowability.

To produce a sintered compact using a powder metallurgical powder, the powder metallurgical mixed powder is compacted (compacted) using a die to give a powder compact, and the powder compact is ejected from the die. The powder compact ejected from the die is sintered and yields the sintered compact.

The powder metallurgical mixed powder, when used, allows the powder compact to be ejected from the die at a lower ejection pressure. This is probably because, when the powder metallurgical mixed powder is charged into the die, the flaky organic material contained in the powder metallurgical mixed powder adheres to the die inner wall.

In addition, the powder metallurgical mixed powder, when used, allows the resulting powder compact to have a higher density. This is probably because as follows. Initially, the flaky organic material has a relatively small average particle diameter within the range and tends to enter the gaps between particles of powders such as iron-based powders. This configuration can sufficiently restrain the flaky organic material from impeding the compaction of the powder metallurgical mixed powder. Accordingly, the powder compact may be allowed to have a higher density. The higher-density powder compact, when further sintered, gives a sintered compact that has a higher density.

The lubricant is a lubricant to be incorporated into a powder metallurgical mixed powder containing an iron-based powder. The powder metallurgical mixed powder has only to contain an iron-based powder, but may further contain an auxiliary material powder and/or a binder as mentioned later. The powder metallurgical mixed powder is preferably one containing an auxiliary material powder, and more preferably one containing graphite as the auxiliary material powder. The powder metallurgical mixed powder containing such auxiliary material powder, when used, can give a sintered compact that has appropriately improved strength. In contrast, a mixed powder, when containing the auxiliary material powder, may tend to suffer from disadvantages such as scattering of the iron-based powder and the auxiliary material powder and segregation of the auxiliary material powder. However, the mixed powder, as containing the lubricant, can restrain the occurrence of these disadvantages. The mixed powder can act as a powder metallurgical powder to give a preferable sintered compact.

The lubricant includes the flaky organic material, as described above. The flaky organic material is more preferably one offering approximately no melting point and having sublimability. Such flaky organic material offering approximately no melting point can give a more preferable sintered compact. This is probably because the flaky organic material does not melt adjacent to the die inner wall upon compaction; and this eliminates or minimizes the adverse effects of a molten flaky organic material on powder compact preparation, and, in addition, sufficiently restrains the adverse effects of the molten flaky organic material on sintering. Examples of the flaky organic material include materials each having a flaky structure including or being derived from a compound having a triazine ring skeleton. More specifically, non-limiting examples of the flaky organic material include materials each having a flaky crystal structure, such as melamine cyanurate and melamine polyphosphates. Of the exemplified flaky organic materials, melamine cyanurate is preferred, because this substance has a multilayer crystal structure and can easily and surely reduce the friction between powder particles upon compaction of the powder metallurgical mixed powder. Melamine cyanurate (melamine-cyanuric acid complex) is a substance that sublimates at 350° C. to 400° C. at normal atmospheric pressure, and does not melt, namely, offers approximately no melting point. The lubricant may include each of different flaky organic materials alone or in combination. The flaky organic materials may be those having undergone a surface treatment such as a silicone treatment and a fatty acid treatment. The surface treatment, when performed on the flaky organic material, allows the powder metallurgical mixed powder to have better flowability. This is probably because the flaky organic material, when having undergone such surface treatment, offers better affinity for powders such as the iron-based powder and allows these powders to be dispersed more satisfactorily. A non-limiting example of the silicone treatment is a silane coupling treatment.

The flaky organic material has an average particle diameter of from 0.1 μm to less than 3 μm, as described above. The lower limit of the average particle diameter of the flaky organic material is 0.1 μm, preferably 1 μm, and more preferably 1.5 μm. In contrast, the average particle diameter of the flaky organic material is less than 3 μm, and the upper limit of the average particle diameter is preferably 2.5 μm, and more preferably 2 μm. The flaky organic material, if having an excessively small average particle diameter, may fail to offer sufficient lubricity even when the flaky organic material is added to the lubricant. This is probably because such an excessively small flaky organic material tends to become embedded in concavities in the iron-based powder surface, and the embedded flaky organic material is hard to contribute to better lubricity. In contrast, the flaky organic material, if having an excessively large average particle diameter, tends to hardly give a preferable powder compact by the compaction of the powder metallurgical mixed powder containing the lubricant. This is probably for the following reasons. First, such an excessively large flaky organic material may probably hardly come into between particles of powders such as the iron-based powder. In addition, the excessively large flaky organic material may probably impede plastic deformation of the powder metallurgical mixed powder containing the lubricant. Accordingly, it is considered that such a flaky organic material having an average particle diameter of from 0.1 μm to less than 3 μm, when incorporated, can give a lubricant that allows the powder metallurgical mixed powder to offer better flowability and to give a sintered compact having a high density.

The lubricant has only to include the flaky organic material Specifically, the lubricant may include the flaky organic material alone, or may further include one or more other components such as an amide compound, a metal soap, and a wax, in addition to the flaky organic material.

The amide compound is not limited, but preferably selected typically from primary amides and secondary amides. Non-limiting examples of the primary amides include stearamide, ethylenebis(stearamide), and hydroxystearamide. Non-limiting examples of the secondary amides include stearylstearamide, oleylstearamide, stearylerucamide, and methylolstearamide. The lubricant may include each of different amide compounds alone or in combination.

The metal soap is not limited and may be exemplified typically by fatty acid salts each containing 12 or more carbon atoms. Among these metal soaps, zinc stearate is preferred. The lubricant may include each of different metal soaps alone or in combination Non-limiting examples of the wax include polyethylene wax, ester waxes, and paraffin wax. The lubricant may include each of different waxes alone or in combination.

The lubricant, when further including another component in addition to the flaky organic material, preferably includes the amide compound as the other component. Namely, the lubricant preferably includes the amide compound.

The lower limit of the melting point of the amide compound is preferably 60° C., more preferably 70° C., and furthermore preferably 80° C. In contrast, the upper limit of the melting point of the amide compound is preferably 130° C., more preferably 120° C., and furthermore preferably 110° C. The amide compound, if having an excessively low melting point, tends to fail to sufficiently effectively contribute to better flowability of the powder metallurgical mixed powder by the addition of the amide compound. The amide compound, if having an excessively high melting point, tends to fail to sufficiently effectively contribute to better flowability of the powder metallurgical mixed powder during compaction of the powder metallurgical mixed powder. This is probably because such a high-melting-point amide compound does not melt and fails to have lower viscosity during compaction of the powder metallurgical mixed powder. Accordingly, the amide compound, when having a melting point within the range, allows the powder metallurgical mixed powder to offer better flowability and to give a sintered compact having a higher density. This is probably for the following reasons. First, the amide compound, when having a melting point within the range, is considered to have a decreasing viscosity as the temperature in the die approaches the melting point and to allow the powder metallurgical mixed powder to offer better flowability, upon plastic deformation of the powder metallurgical mixed powder. In addition, this amide compound is considered to easily and surely come into between particles of powders such as the iron-based powder and between the powders and the die. These probably allow the powder metallurgical mixed powder to have still better flowability and to give a sintered compact having a still higher density.

The lower limit of the amide compound content is preferably 10 parts by mass, more preferably 20 parts by mass, and furthermore preferably 30 parts by mass, per 100 parts by mass of the flaky organic material. In contrast, the upper limit of the amide compound content is preferably 90 parts by mass, more preferably 80 parts by mass, and furthermore preferably 70 parts by mass, per 100 parts by mass of the flaky organic material. The amide compound, if present in an excessively low content, may fail to offer sufficient effects of the addition of the amide compound. In contrast, the amide compound, if present in an excessively high content, may cause the powder metallurgical mixed powder to offer lower compressibility. Accordingly, the amide compound, when present in a content within the range, allows the powder metallurgical mixed powder to have still better flowability and to give a sintered compact having a still higher density.

The lower limit of the lubricant proportion in the powder metallurgical mixed powder is preferably 0.01 mass percent, more preferably 0.05 mass percent, and furthermore preferably 0.1 mass percent. In contrast, the upper limit of the lubricant proportion in the powder metallurgical mixed powder is preferably 1.5 mass percent, more preferably 1 mass percent, and furthermore preferably 0.7 mass percent. The lubricant, if present in an excessively small proportion, tends to fail to offer sufficient effects of addition thereof to the powder metallurgical mixed powder. Specifically, this lubricant may fail to contribute to sufficiently better lubricity of the powder metallurgical mixed powder. In contrast, the lubricant, if present in an excessively large proportion, may cause the powder metallurgical mixed powder to offer lower compressibility. Accordingly, the lubricant, when present in a proportion within the range in the powder metallurgical mixed powder, allows the powder metallurgical mixed powder to have still better flowability and to give a sintered compact having a still higher density.

Advantages of Lubricant

The lubricant includes the flaky organic material having an average particle diameter of from 0.1 μm to less than 3 μm. Assume that the lubricant as above is incorporated into a powder metallurgical mixed powder containing an iron-based powder. In this case, the flaky organic material, as having an average particle diameter within the range, relatively readily becomes embedded in (comes into) gaps typically between particles of powders such as the iron-based powder contained in the powder metallurgical mixed powder and allows the powder metallurgical mixed powder to offer better lubricity. Namely, the incorporation of the lubricant gives a powder metallurgical mixed powder having excellent flowability.

Assume that the lubricant is incorporated into a powder metallurgical mixed powder to produce a sintered compact. In this case, the lubricant, as including the flaky organic material having an average particle diameter within the range, allows the powder metallurgical mixed powder to be appropriately compacted upon compaction and yielded a preferable powder compact. Accordingly, this powder compact, when sintered to give a sintered compact, promotively allows the sintered compact to have a higher density and consequently to have higher quality. In addition, when the powder metallurgical mixed powder containing the lubricant is compacted in a die to give a powder compact, the lubricant offers a lower ejection pressure upon ejection (drawing) of the powder compact from the die. This is probably because, when the powder metallurgical mixed powder is charged into the die, part of the flaky organic material contained in the lubricant adheres to the die inner wall. The flaky organic material, when offering approximately no melting point, can adhere to the die inner wall without melting upon charging of the powder metallurgical mixed powder into the die and contributes to further reduction of the ejection pressure.

Second Embodiment

Powder Metallurgical Mixed Powder

A powder metallurgical mixed powder according to another embodiment of the present invention contains an iron-based powder and the lubricant. The powder metallurgical mixed powder may contain the iron-based powder and the lubricant alone, or may further contain one or more other components. Non-limiting examples of such other components include auxiliary material powders and binders.

Iron-Based Powder

The iron-based powder is a principal material of the powder metallurgical mixed powder. The iron-based powder includes iron as a principal component. Non-limiting examples of the iron-based powder include pure iron powders and iron alloy powders. Specifically, the iron-based powder may be selected from pure iron powders and iron alloy powders. The iron alloy powders are not limited, and may be selected typically from partially alloyed powders which include an iron powder and an alloy powder typically of copper, nickel, chromium, and/or molybdenum diffused and adhered to the surface of the iron powder; and pre-alloyed powders which are obtained from molten iron or molten steel containing an alloy component. Non-limiting examples of methods for producing the iron-based powder include a method of subjecting molten iron or steel to an atomization treatment; and a method of reducing iron ores or mill scale. As used herein, the term "principal material" refers to, of raw materials, a raw material present in a highest content. For example, the "principal material" refers to a raw material present in a content of 50 mass percent or more. Also as used herein, the term "principal component" refers to a component present in a highest content, and refers typically to a component present in a content of 50 mass percent or more.

The lower limit of the average particle diameter of the iron-based powder is preferably 40 μm, more preferably 50 μm, and furthermore preferably 60 μm. In contrast, the upper limit of the average particle diameter of the iron-based powder is preferably 120 μm, more preferably 100 μm, and furthermore preferably 80 μm. The iron-based powder, if having an excessively small average particle diameter, may have lower handleability. In contrast, the iron-based powder, if having an excessively large average particle diameter, may cause the lubricant to become embedded in concavities (between convexes) in the iron-based powder surface. Accordingly, the iron-based powder, when having an average particle diameter within the range, can give a better powder metallurgical mixed powder. For example, this powder metallurgical mixed powder can give a sintered compact having a still higher density.

Auxiliary Material Powder

The powder metallurgical mixed powder may contain the auxiliary material powder as an optional component according typically to desired properties. The auxiliary material powder, when contained, allows the sintered compact to vary in properties depending on the type of the auxiliary material powder. For example, an auxiliary material powder may allow the sintered compact obtained from the powder metallurgical mixed powder to have higher strength. Non-limiting examples of the auxiliary material powder include powders typically of alloy elements such as copper, nickel, chromium, and molybdenum; and other inorganic or organic components such as phosphorus, sulfur, graphite, graphite fluoride, manganese sulfide, talc, and calcium fluoride. Among the exemplified auxiliary material powders, graphite is preferred so as to allow the sintered compact obtained from the powder metallurgical mixed powder to have appropriately high strength.

The upper limit of the auxiliary material powder content is preferably 10 parts by mass, more preferably 7 parts by mass, and furthermore preferably 5 parts by mass, per 100 parts by mass of the iron-based powder. In contrast, the mixed powder does not always have to contain the auxiliary material powder, and the lower limit of the auxiliary material powder content may be 0 part by mass. However, when the mixed powder contains the auxiliary material powder, the lower limit of the auxiliary material powder content is preferably 0.1 part by mass, more preferably 0.5 part by mass, and furthermore preferably 1 part by mass, per 100 parts by mass of the iron-based powder. The auxiliary material powder, if present in an excessively high content per 100 parts by mass of the iron-based powder, may cause the resulting sintered compact to have a lower density and to thereby have lower strength. In contrast, the auxiliary material powder, if present in an excessively low content, may fail to offer sufficient effects by the addition thereof. For example, the auxiliary material powder, even when contained so as to allow the sintered compact to have higher strength, may fail to offer such higher strength sufficiently effectively. Accordingly, the auxiliary material powder, when present in a content within the range, may give a powder metallurgical mixed powder which is more preferable and is capable of giving a more preferable sintered compact.

Binder

The powder metallurgical mixed powder may contain the binder as needed. The binder, when present, can eliminate or minimize disadvantages such as scattering of powders such as the iron-based powder and the auxiliary material powder and segregation of the auxiliary material powder. The binder is not limited and may be exemplified typically by polyolefins, acrylic resins, polystyrenes, styrene butadiene rubber, ethylene glycol distearate, epoxy resins, and rosin esters.

Among the exemplified compounds, the binder is preferably selected from polyolefins and acrylic resins. The binder for use herein preferably includes at least one of a polyolefin and an acrylic resin and more preferably includes both a polyolefin and an acrylic resin.

Non-limiting examples of the polyolefin include butene polymers. Examples of the butane polymers include butane homopolymers derived from butane alone; and copolymers of butene with another alkene. Non-limiting examples of the copolymers include butane-ethylene copolymers and butene-propylene copolymers. The polyolefin may structurally further be derived from or include any other monomer or polymer. For example, a butene-ethylene copolymer further derived from vinyl acetate has a lower melting point.

The lower limit of the melting point of the polyolefin is preferably 45° C., more preferably 50° C., and furthermore preferably 55° C. In contrast, the upper limit of the melting point of the polyolefin is preferably 90° C., more preferably 85° C., and furthermore preferably 80° C. The polyolefin, if having an excessively low melting point, may cause the powder metallurgical mixed powder to have excessively high tackiness and to fail to offer sufficiently high flowability at elevated temperatures of the mixed powder. In contrast, the polyolefin, if having an excessively high melting point, may offer weaker adhesion to the iron-based powder and may fail to sufficiently eliminate or minimize segregation and dust emission. Accordingly, the polyolefin, when having a melting point within the range, allows the binder to offer its effects effectively and gives a more preferable powder metallurgical mixed powder. For example, this polyolefin can appropriately eliminate or minimize disadvantages such as scattering of powders such as the iron-based powder and the auxiliary material powder, and segregation of the auxiliary material powder.

The lower limit of the melt flow rate (MER) of the polyolefin at 190° C. is preferably 2.8 g/10 min., and more preferably 3.2 g/10 min. In contrast, the melt flow rate of the polyolefin at 190° C. is preferably 3.8 g/10 min., and more preferably 3.4 g/10 min. The polyolefin, if having an excessively low or excessively high melt flow rate at 190° C., may have lower flowability and may consequently cause the powder metallurgical mixed powder to fail to have sufficiently high flowability. Accordingly, the polyolefin, when having a melt flow rate at 190° C. within the range, allows the binder to offer effects of its presence effectively and to give a more preferable powder metallurgical mixed powder.

The polyolefin is not limited on weight-average molecular weight and other properties. The polyolefin may therefore be any of random copolymers, alternating copolymers, block copolymers, and graft copolymers. Regarding the structure, these copolymers may have any of linear and branched structures.

Non-limiting examples of the acrylic resin include poly (methyl methacrylate)s, poly(ethyl methacrylate)s, poly(butyl methacrylate)s, poly(cyclohexyl methacrylate)s, poly (ethylhexyl methacrylate)s, poly(lauryl methacrylate)s, poly (methyl acrylate)s, and poly(ethyl acrylate)s. The acrylic resin is preferably selected from acrylic resins each having an approximately linear structural formula. Specifically, among the exemplified compounds, the acrylic resin is preferably selected from poly(methyl methacrylate)s, poly (ethyl methacrylate)s, poly(butyl methacrylate)s, poly(methyl acrylate)s, and poly(ethyl acrylate)s, and particularly preferably selected from poly(methyl methacrylate)s, poly (ethyl methacrylate)s, and poly(butyl methacrylate)s.

The upper limit of the weight-average molecular weight of the acrylic resin is preferably 5th $10^4$, more preferably 4th $10^4$, and furthermore preferably $35\times10^4$. The acrylic resin, if having an excessively high weight-average molecular weight, may fail to eliminate or minimize segregation of the auxiliary material powder. This is probably because the viscosity of the resulting binder may become hard to control upon melting and upon dissolution in an organic solvent, and this may fail to allow the iron-based powder and the auxiliary material powder to have appropriately improved tackiness. In contrast, the acrylic resin, when having a weight-average molecular weight within the range, may allow the auxiliary material powder to be more uniformly dispersed in the powder metallurgical mixed powder and to have better flowability at high temperatures of about 50° C. to about 70° C. In view of better flowability, the lower limit of the weight-average molecular weight of the acrylic resin is not limited. However, the acrylic resin, if having an excessively low weight-average molecular weight, may have excessively low viscosity. To eliminate or minimize this, the lower limit of the weight-average molecular weight of the acrylic resin may be set typically to $15\times10^4$, and preferably to $20\times10^4$.

Assume that the powder metallurgical mixed powder contains a binder including a polyolefin having a melting point and a melt flow rate within the ranges and/or an acrylic resin having a weight-average molecular weight within the range. This mixed powder can appropriately eliminate or minimize segregation and scattering of components such as the auxiliary material powder. So as to appropriately eliminate or minimize segregation and scattering of components such as the auxiliary material powder, the powder metallurgical mixed powder preferably contains a binder including both the polyolefin and the acrylic resin.

Assume that the binder includes both the polyolefin and the acrylic resin. In this case, the lower limit of the acrylic resin content is preferably 10 parts by mass, more preferably 15 parts by mass, and furthermore preferably 20 parts by mass, per 100 parts by mass of the polyolefin. The acrylic resin, when present in a content within the range, may further appropriately eliminate or minimize segregation of components such as the auxiliary material powder. Also assume that the binder includes both the polyolefin and the acrylic resin. In this case, the upper limit of the acrylic resin content per 100 parts by mass of the polyolefin is not limited in view of elimination or minimization of scattering of powders such as the iron-based powder and the auxiliary material powder, and segregation of the auxiliary material powder. However, for allowing the powder metallurgical mixed powder to easily and reliably have better flowability, the upper limit of the acrylic resin content may be set typically to 80 parts by mass, and preferably to 60 parts by mass, per 100 parts by mass of the polyolefin.

The upper limit of the binder content is preferably 0.5 part by mass, and more preferably 0.2 part by mass, per 100 parts by mass of the total amount of the iron-based powder and the auxiliary material powder. The binder, if present in an excessively high content, may fail to allow the resulting sintered compact to have a sufficiently high density. In contrast, the powder metallurgical mixed powder may contain the binder so as to eliminate or minimize scattering of the iron-based powder and the auxiliary material powder, and segregation of the auxiliary material powder. The powder metallurgical mixed powder, when having low possibility of the scattering and segregation of these powders, does not always have to contain the binder. Accordingly, the lower limit of the binder content may be set to 0 part by mass per 100 parts by mass of the total amount of the iron-based powder and the auxiliary material powder. However, when the mixed powder contains the binder, the lower limit of the binder content is preferably 0.01 part by mass per 100 parts by mass of the total amount of the iron-based powder and the auxiliary material powder. The binder, if present in an excessively low content, may fail to sufficiently offer effects of its presence. Specifically, the binder may fail to sufficiently eliminate or minimize scattering of the iron-based powder and the auxiliary material powder, and segregation of the auxiliary material powder.

Advantages of Powder Metallurgical Mixed Powder

The powder metallurgical mixed powder, as containing the lubricant, can have better lubricity and promotively allows the resulting sintered compact to have a higher density and, consequently, to have higher quality, as described above. In addition, the powder metallurgical mixed powder allows the powder compact to be ejected from the die at a lower ejection pressure, as described above.

Third Embodiment

Sintered Compact Production Method

Next, a method for producing a sintered compact using the powder metallurgical mixed powder will be illustrated. The sintered compact production method is not limited, as long as being a method that gives a sintered compact using the powder metallurgical mixed powder. For example, the method may include a mixing step, a compacting step, and a sintering step. Specifically, a non-limiting example of the sintered compact production method is a method including a mixing step, a compacting step, and a sintering step. In the mixing step, a powder metallurgical mixed powder containing the iron-based powder and the lubricant is obtained. In the compacting step, the powder metallurgical mixed powder is compacted using a die to give a powder compact. In the sintering step, the powder compact is sintered to give a sintered compact.

Mixing Step

The mixing step is not limited, as long as being the step of mixing the iron-based powder with the lubricant to give a powder metallurgical mixed powder containing the iron-based powder and the lubricant. The lubricant to be used in the mixing step is the abovementioned lubricant including the flaky organic material having an average particle diameter of from 0.1 μm to less than 3 μm. The mixing step may be performed by mixing components further including the auxiliary material powder and/or the binder as needed, in addition to the iron-based powder and the lubricant. This gives a powder metallurgical mixed powder containing not only the iron-based powder and the lubricant, but also the auxiliary material powder and/or the binder. Since the powder metallurgical mixed powder is preferably one containing the auxiliary material powder, the mixing step is preferably the step of mixing the iron-based powder, the lubricant, and the auxiliary material powder with one another.

In an embodiment, the mixing step includes mixing the iron-based powder, the lubricant, the auxiliary material powder, and the binder with one another. This embodiment will be illustrated below. Initially, the iron-based powder, the auxiliary material powder, and the binder are charged into known mixing equipment, mixed with heating, and then cooled. This allows the binder to solidify and to adhere onto the iron-based powder and the auxiliary material powder, and the adhered binder allows particles of the iron-based powder and the auxiliary material powder to be combined with each other and, as a result, eliminates or minimizes the segregation and scattering. Non-limiting examples of the mixing equipment for use herein include mixers, high-speed mixers, Nauta Mixers, twin-shell blenders (V-type blenders), and double cone blenders.

Next, the cooled powder mixture is combined with the lubricant. This gives the powder metallurgical mixed powder.

The binder may be mixed typically in a molten state, or may be mixed in a powdery state and be melted by friction heat generated typically by interparticle friction during the mixing process, or may be melted by heating up to a predetermined temperature with an external heat source. When the binder is mixed in a molten state, in general, the molten binder is preferably mixed not as intact, but as a solution prepared by dissolving the molten binder in a volatile organic solvent such as toluene or acetone.

Mixing conditions for the other components than the lubricant are not limited, as long as capable of mixing components such as the iron-based powder, and optional components added as needed, such as the auxiliary material powder and the binder, with each other. Specifically, the mixing conditions may be set as appropriate according to conditions such as the mixing equipment and the production scale. The mixing may be performed in the following manner. For example, the mixing, when using an impeller mixer, may be performed by agitating components at an impeller rotation speed controlled within the range of about 2 m/s to 10 m/s for about 0.5 min to 20 min. The mixing, when using a twin-shell blender or a double cone blender, may be performed by blending at about 2 rpm to about 50 rpm for 1 min to 60 min. Mixing conditions for the lubricant are not limited, as long as capable of mixing the lubricant, and are exemplified by conditions as with the mixing conditions for the other components than the lubricant.

The mixing temperature for the other components than the lubricant is not limited and may be set typically at 40° C. to 60° C. The mixing, if performed at an excessively low temperature, may fail to provide appropriate mixing of the iron-based powder with optional components added as needed, such as the auxiliary material powder and the binder. In this case, for example, the binder may have an excessively high viscosity and may fail to be dispersed satisfactorily uniformly in the powder metallurgical mixed powder. In contrast, the mixing, if performed at an excessively high temperature, may cause the components of the powder metallurgical mixed powder to be damaged and/or to fail to be mixed appropriately. In addition, the cost of the heating equipment may increase more than necessary. Accordingly, the mixing, when performed at a temperature within the range, can provide appropriate mixing of the iron-based powder with optional components added as needed. The mixing temperature for the lubricant is not limited, as long as capable of mixing the lubricant, and is exemplified typically by temperatures as with the mixing temperature of the other components than the lubricant. This allows the lubricant also to be mixed appropriately and to give a preferable powder metallurgical mixed powder.

Compacting Step

The compacting step is not limited, as long as being the step of compacting the powder metallurgical mixed powder using a die to yield a powder compact. The compacting step may be performed typically by charging the powder metallurgical mixed powder into the die and applying pressure at 490 MPa to 686 MPa to the mixed powder. The compaction temperature may differ depending typically on the types and amounts of components constituting the powder metallurgical mixed powder, and on the compaction pressure, is not limited, but may be set typically at 25° C. to 150° C.

Sintering Step

The sintering step is not limited, as long as being the step of sintering the powder compact to yield a sintered compact. The sintering conditions may differ depending typically on the types of components constituting the powder compact, and on the type of the resulting sintered compact, and are not limited. The sintering temperature in the sintering step is not limited, as long as being such a temperature as to give a sintered compact from the powder compact, but is preferably a temperature equal to or lower than the melting point of the iron-based powder, and more preferably from 1000° C. to 1300° C. Specifically, but exemplarily, the sintering step may be performed typically by sintering in an atmosphere typically of $N_2$, $N_2$—$H_2$, and/or a hydrocarbon at a temperature of 1000° C. to 1300° C. for 5 min to 60 min.

Advantages of Sintered Compact Production Method

The sintered compact production method uses the powder metallurgical mixed powder containing the lubricant and can give a sintered compact having a higher density. This sintered compact is a sintered compact offering still higher quality enhanced due to the higher density.

As used herein, the term "average particle diameter" refers to a cumulative 50% mean volume diameter (median diameter, 50% particle diameter, d50). The diameter d50 can be measured by a regular measurement method of an average particle diameter and can be measured typically by measurement via diffraction/scattering method; or measurement using a common particle size meter. As used herein, the term "melting point" refers to a melting point peak temperature as measured with a differential scanning calorimeter (DSC). The term "flaky organic material" refers to a material having a flaky structure containing one or more carbon atoms as constitutive atoms. The flaky organic material may contain carbon atoms in a content of typically 20 mass percent or more, and preferably 30 mass percent or more. The term "flaky" refers typically to such a state as to have a ratio of an average thickness to an average length of from 1200 to 1:5, and preferably from 1:100 to 1/20, where the average length is an average length of a major dimension in a plane and a minor dimension perpendicular to the major dimension; and the average thickness refers to an average thickness in a direction perpendicular to the plane. As used herein, the term "major dimension" refers to the length of a longest straight line in the plane; and the term "minor dimension" refers to the length of a longest straight line among lines perpendicular to the major dimension in the plane. The "melt flow rate (MFR)" refers to a value measured in conformity to JIS K 7210:1999, "Appendix (JIS) A Table 1" at a test temperature of 190° C. and a load of 2.16 kg. The "weight-average molecular weight" refers to a value measured in conformity to JIS K 7252:2008 via gel permeation chromatography (GPC).

As described above, technologies according to various embodiments are disclosed in the description. Among them, principal technologies will be summarized below.

The present invention, according to one aspect, provides a lubricant to be incorporated into a powder metallurgical mixed powder containing an iron-based powder. The lubricant includes a flaky organic material having an average particle diameter of from 0.1 μm to less than 3 μm.

The lubricant, as including the flaky organic material having an average particle diameter within the range, becomes relatively easily embedded in (comes into) gaps between particles of powders such as the iron-based powder contained in the powder metallurgical mixed powder and allows the powder metallurgical mixed powder to have better lubricity. Specifically, the presence of the lubricant gives a powder metallurgical mixed powder having preferable flowability.

The powder metallurgical mixed powder, when used, can give a powder compact having a higher density. This is probably because as follows. The lubricant includes such a relatively small flaky organic material having an average particle diameter within the range, may rarely impede compaction of the powder metallurgical mixed powder, and promotively allows the resulting sintered compact to have a higher density. Accordingly, the lubricant allows the powder compact to have a higher density, and the powder compact having such a higher density, when sintered, gives a sintered compact that has a higher density. Specifically, the lubricant promotively allows the sintered compact to have higher quality.

In addition, the lubricant can contribute to reduction in ejection pressure of the powder compact from a die, where the powder compact is obtained by compacting the powder metallurgical mixed powder. This is probably because part of the flaky organic material constituting the lubricant adheres to the die inner wall when the powder metallurgical mixed powder is charged into the die.

From the above, the configuration can give a lubricant that allows a powder metallurgical mixed powder to offer better flowability and to give a sintered compact having a high density.

The flaky organic material in the lubricant preferably offers approximately no melting point.

The configuration as above can provide a lubricant that gives a more preferable sintered compact. This is probably because as follows. Initially, the flaky organic material does not melt adjacent to the die inner wall during compaction and does not impede the formation of a powder compact, where the formation may be impeded by a molten flaky organic material. In sintering, the configuration can also sufficiently restrain adverse effects of such molten flaky organic material on sintering.

The lubricant preferably includes melamine cyanurate as the flaky organic material.

As described above, melamine cyanurate, when employed as the flaky organic material, can easily provide a flaky structure and can easily and reliably reduce the friction between particles of powders during compaction of the powder metallurgical mixed powder.

The lubricant preferably further includes an amide compound. The lubricant may contain the amide compound in a content of preferably 10 parts by mass to 90 parts by mass per 100 parts by mass of the flaky organic material.

As described above, the lubricant, when further including an amide compound in a content within the range relative to the flaky organic material, allows the powder metallurgical mixed powder to have still better lubricity.

The flaky organic material in the lubricant preferably has undergone at least one surface treatment selected from the group consisting of silicone treatments and fatty acid treatments.

This configuration allows the powder metallurgical mixed powder to offer better flowability. This is probably because the flaky organic material, when having undergone the surface treatment, has higher affinity for the particles of powders such as the iron-based powder and allows the powders to be dispersed more satisfactorily.

The lubricant is preferably incorporated into the powder metallurgical mixed powder further containing an auxiliary material powder. The auxiliary material powder preferably includes graphite.

According to the configuration as above, the powder metallurgical mixed powder further containing such an auxiliary material powder, when used to give a sintered compact, allows the resulting sintered compact to offer effects, such as higher strength, obtained by the addition of the auxiliary material powder. For example, the powder metallurgical mixed powder, when containing graphite as the auxiliary material powder, allows the resulting sintered compact to have higher strength. In contrast, a powder metallurgical mixed powder, when containing such an auxiliary material powder, tends to suffer from disadvantages such as scattering of powders such as the iron-based powder and the auxiliary material powder, and segregation of the auxiliary material powder. However, the powder metallurgical mixed powder herein contains the lubricant and can restrain the occurrence of these disadvantages. Accordingly, the lubricant having this configuration can be incorporated into a powder metallurgical mixed powder to give a more preferable sintered compact.

The present invention provides, in another aspect, a powder metallurgical mixed powder containing an iron-based powder and the lubricant.

The powder metallurgical mixed powder, as containing the lubricant, has better lubricity and promotively allows the resulting sintered compact to have a higher density and consequently to have higher quality, as described above. In addition, the powder metallurgical mixed powder contributes to reduction in ejection pressure from the die, as described above.

The powder metallurgical mixed powder preferably further contains a binder; and the binder preferably includes at least one selected from the group consisting of polyolefins having a melting point of 45° C. to 90° C. or lower and a melt flow rate at 190° C. of 2.8 g/10 min. to 3.8 g/10 min.; and acrylic resins having a weight-average molecular weight of $50\times10^4$ or less.

Assume that the mixed powder further contains a binder, and the binder includes at least one of a polyolefin having a melting point and a melt flow rate within the ranges and an acrylic resin having a weight-average molecular weight within the range, as above. This configuration can appropriately eliminate or minimize the segregation and scattering of powers such as the iron-based powder.

In the powder metallurgical mixed powder, the binder preferably includes both the polyolefin and the acrylic resin and preferably contains the acrylic resin in a content of 10 parts by mass or more per 100 parts by mass of the polyolefin.

As described above, the binder, when including both the polyolefin and the acrylic resin and containing the acrylic resin in a content within the range relative to the polyolefin, can eliminate or minimize segregation and scattering of powders such as the iron-based powder and contributes to still better flowability of the mixed powder.

The powder metallurgical mixed powder preferably further contains an auxiliary material powder. The auxiliary material powder preferably includes graphite.

This configuration can provide a powder metallurgical mixed powder that can give a more preferable sintered compact. Initially, the powder metallurgical mixed powder containing an auxiliary material powder, when used to give a sintered compact, allows the sintered compact to offer effects, such as higher strength, obtained by the addition of the auxiliary material powder. For example, the powder metallurgical mixed powder, when containing graphite as the auxiliary material powder and used to give a sintered compact, allows the sintered compact to have higher strength. In contrast, the auxiliary material powder, when contained, tends to cause disadvantages such as scattering of the iron-based powder and the auxiliary material powder, and segregation of the auxiliary material powder. The powder metallurgical mixed powder herein, however, contains the lubricant and can restrain the occurrence of these disadvantages. This allows the powder metallurgical mixed powder to give a more preferable sintered compact.

The present invention provides, in yet another aspect, a method for producing a sintered compact. The method includes a mixing step, a compacting step, and a sintering step. In the mixing step, materials are mixed to give a powder metallurgical mixed powder containing an iron-based powder and the lubricant. In the compacting step, the powder metallurgical mixed powder is compacted using a die to vie a powder compact. In the sintering step, the powder compact is sintered to give a sintered compact.

The sintered compact production method employs the powder metallurgical mixed powder containing the lubricant and can produce a sintered compact having a higher density. Accordingly, the method can produce a sintered compact having higher quality as enhanced due to the higher density.

The mixing step in the sintered compact production method preferably includes mixing the iron-based powder, the lubricant, and the auxiliary material powder with one another. The auxiliary material powder preferably includes graphite.

The configuration as above can produce a more preferable sintered compact.

As described above, the lubricant, the powder metallurgical mixed powder, and the sintered compact production method according to the present invention can allow the powder metallurgical mixed powder to have better flowability and can promotively allow the resulting sintered compact to have a higher density.

EXAMPLES

The present invention will be illustrated in further detail with reference to several examples below. It should be noted, however, that the examples are by no means intended to limit the scope of the present invention.

Example 1

A pure iron powder (ATOMEL 300M, supplied by Kabushiki Kaisha Kobe Seiko Sho (Kobe Steel, Ltd), having a particle diameter of 40 to 120 μm) was prepared as an iron-based powder. With 100 parts by mass of the pure iron powder, 2.0 parts by mass of a copper powder and 0.8 part by mass of graphite as auxiliary material powders were mixed using a twin-shell blender. In addition, 0.10 part by mass of styrene-butadiene rubber as a binder was sprayed over the pure iron powder and the auxiliary material powder, the resulting powders were stirred and mixed, and yielded a powder mixture coated with the binder. The binder was sprayed as a binder solution prepared by dissolving the styrene-butadiene rubber to a binder concentration of 2.5 mass percent in toluene. The powder mixture was further combined with 0.5 mass percent of melamine cyanurate (MC-6000, supplied by Nissan Chemical Industries, Ltd) having an average particle diameter of 2.0 μm as a flaky organic material (as a lubricant) and yielded a powder metallurgical mixed powder. The melamine cyanurate (cyanuric acid-melamine complex) is a substance which sublimates at 350° C. to 400° C. and does not melt at normal atmospheric pressure. Namely, this substance is a flaky organic material offering approximately no melting point.

Example 2

A powder metallurgical mixed powder according to Example 2 was prepared by a procedure similar to that in Example 1, except for using, as the flaky organic material, a melamine cyanurate having an average particle diameter of 1.2 μm (MC-1N, supplied by Sakai Chemical Industry Ca, Ltd).

Example 3

A powder metallurgical mixed powder according to Example 3 was prepared by a procedure similar to that in Example 1, except for using, as the flaky organic material, a melamine cyanurate having an average particle diameter of 2.7 μm and having undergone a silicone surface treatment (MC-20S, supplied by Sakai Chemical Industry Co., Ltd.).

Example 4

A powder metallurgical mixed powder according to Example 4 was prepared by a procedure similar to that in Example 1, except for using, as the flaky organic material, a melamine cyanurate having an average particle diameter of 1.0 μm and having undergone a fatty acid surface treatment. (MC-5F, supplied by Sakai Chemical Industry Co., Ltd.)

Example 5

A powder metallurgical mixed powder according to Example 5 was prepared by a procedure similar to that in Example 1, except for using, as the lubricant stearamide (Amide AP-1, supplied by Nippon Kasei Chemical Co., Ltd.) in a compositional ratio (mole ratio) given in Table 1, in addition to the melamine cyanurate having an average particle diameter of 2.0 μm (MC-6000, supplied by Nissan Chemical Industries, Ltd.).

Examples 6 to 8

Powder metallurgical mixed powders according to Examples 6 to 8 were prepared by a procedure similar to that in Example 5, except for using the melamine cyanurate and stearamide in compositional ratios (mole ratios) in the powder metallurgical mixed powders, as given in Table 1.

Example 9

A powder metallurgical mixed powder according to Example 9 was prepared by a procedure similar to that in Example 1, except for using, as the binder, a butene-propylene copolymer (TAFMER XM5080, supplied by Mitsui Chemicals Inc., having a melting point of 85° C. and a melt flow rate (MFR) at 190° C. of 3.0 g/10 min).

Example 10

A powder metallurgical mixed powder according to Example 10 was prepared by a procedure similar to that in Example 1, except for using, as the binder, a butene-propylene copolymer (TAFMER XM5070, supplied by Mitsui Chemicals Inc., having a melting point of 77° C. and a melt flow rate of 3.0 g/10 min).

Example 11

A powder metallurgical mixed powder according to Example 11 was prepared by a procedure similar to that in Example 1, except for using, as the binder, a butene-ethylene copolymer (TAFMER DF740, supplied by Mitsui Chemicals Inc., having a melting point of 55° C. and a melt flow rate of 3.6 g/10 min).

Example 12

A powder metallurgical mixed powder according to Example 12 was prepared by a procedure similar to that in Example 1, except for using, as the binder, a butene-ethylene copolymer (TAFMER DF740, supplied by Mitsui Chemicals Inc., having a melting point of 50° C. and a melt flow rate of 3.6 g/10 min).

Example 13

A powder metallurgical mixed powder according to Example 13 was prepared by a procedure similar to that in Example 1, except for using, as the binder, butyl methacrylate (M-6003, supplied by Negami Chemical Industrial Co., Ltd, having a weight-average molecular weight of 376500).

Example 14

A powder metallurgical mixed powder according to Example 14 was prepared by a procedure similar to that in Example 1, except for using, as the binder, a 90:10 (by mass) mixture of the butene-propylene copolymer used in Example 9 and the butyl methacrylate used in Example 13.

Example 15

A powder metallurgical mixed powder according to Example 15 was prepared by a procedure similar to that in Example 1, except for using, as the binder, a 90:10 (in mass ratio) mixture of the butene-propylene copolymer used in Example 10 and the butyl methacrylate used in Example 13.

Comparative Example 1

A powder metallurgical mixed powder according to Comparative Example 1 was prepared by a procedure similar to that in Example 1, except for using, as the lubricant, ethylenebis(stearamide) (WXDBS, supplied by Dainichi Kagaku Kogyo KK.).

Comparative Example 2

A powder metallurgical mixed powder according to Comparative Example 2 was prepared by a procedure similar to that in Example 1, except for using, as the lubricant, zinc stearate (Daiwax Z, supplied by Dainichi Kagaku Kogyo KK).

Comparative Example 3

A powder metallurgical mixed powder according to Comparative Example 3 was prepared by a procedure similar to that in Example 1, except for using, as the lubricant, a melamine cyanurate having an average particle diameter of 14 μm (MC-4500, supplied by Nissan Chemical Industries, Ltd).

Comparative Example 4

A powder metallurgical mixed powder according to Comparative Example 4 was prepared by a procedure similar to that in Example 1, except for using, as the lubricant, a melamine cyanurate having an average particle diameter of 10 μm (MC-4000, supplied by Nissan Chemical Industries, Ltd.).

Comparative Example 5

A powder metallurgical mixed powder according to Comparative Example 5 was prepared by a procedure similar to that in Example 1, except for using, as the lubricant, a melamine cyanurate having an average particle diameter of 3.3 μm (MC-2010N, supplied by Sakai Chemical Industry Co., Ltd.).

TABLE 1

| | Lubricant | | | | | Binder | | |
|---|---|---|---|---|---|---|---|---|
| | Flaky organic compound | | | | Constitutional ratio (flaky organic compound to amide compound) | | | |
| | Compound | Average particle diameter (μm) | Surface treatment | Amide compound Component | | Component | Melting point (° C.) | MFR (g/10 min) |
| Example 1 | Melamine cyanurate | 2.0 | — | — | — | Styrene butadiene rubber | — | 13.0 |
| Example 2 | Melamine cyanurate | 1.2 | — | — | — | Styrene butadiene rubber | — | 13.0 |

TABLE 1-continued

| | Lubricant | | | | | Binder | | |
|---|---|---|---|---|---|---|---|---|
| | Flaky organic compound | | | | Constitutional ratio (flaky organic compound to amide compound) | | | |
| | Compound | Average particle diameter (μm) | Surface treatment | Amide compound Component | | Component | Melting point (° C.) | MFR (g/10 min) |
| Example 3 | Melamine cyanurate | 2.7 | Silicone treatment | — | — | Styrene butadiene rubber | — | 13.0 |
| Example 4 | Melamine cyanurate | 1.0 | Fatty acid treatment | — | — | Styrene butadiene rubber | — | 13.0 |
| Example 5 | Melamine cyanurate | 2.0 | — | Stearamide | 10/90 | Styrene butadiene rubber | — | 13.0 |
| Example 6 | Melamine cyanurate | 2.0 | — | Stearamide | 30/70 | Styrene butadiene rubber | — | 13.0 |
| Example 7 | Melamine cyanurate | 2.0 | — | Stearamide | 70/30 | Styrene butadiene rubber | — | 13.0 |
| Example 8 | Melamine cyanurate | 2.0 | — | Stearamide | 90/10 | Styrene butadiene rubber | — | 13.0 |
| Example 9 | Melamine cyanurate | 2.0 | — | — | — | Butene-propylene copolymer | 85 | 3.0 |
| Example 10 | Melamine cyanurate | 2.0 | — | — | — | Butene-propylene copolymer | 77 | 3.0 |
| Example 11 | Melamine cyanurate | 2.0 | — | — | — | Butene-ethylene copolymer | 55 | 3.6 |
| Example 12 | Melamine cyanurate | 2.0 | — | — | — | Butene-ethylene copolymer | 50 | 3.6 |
| Example 13 | Melamine cyanurate | 2.0 | — | — | — | Butyl methacrylate | — | — |
| Example 14 | Melamine cyanurate | 2.0 | — | — | — | Butene-propylene copolymer: butyl methacrylate (90:10) | — | — |
| Example 15 | Melamine cyanurate | 2.0 | — | — | — | Butene-propylene copolymer: butyl methacrylate (90:10) | — | — |
| Comparative example 1 | Ethylenebis (stearamide) | Maximum particle diameter 75 μm | — | — | — | Styrene butadiene rubber | — | 13.0 |
| Comparative example 2 | Zinc stearate | Maximum particle diameter 45 μm | — | — | — | Styrene butadiene rubber | — | 13.0 |
| Comparative example 3 | Melamine cyanurate | 14 | — | — | — | Styrene butadiene rubber | — | 13.0 |
| Comparative example 4 | Melamine cyanurate | 10 | — | — | — | Styrene butadiene rubber | — | 13.0 |
| Comparative example 5 | Melamine cyanurate | 3.3 | — | — | — | Styrene butadiene rubber | — | 13.0 |

Flowability

A flow test was performed in conformity to JIS Z 2502: 2012 (Metallic powders–Determination offlow rate) to determine the flow rate of a sample powder metallurgical mixed powder. Specifically, a time (in second) for 50 g of the powder metallurgical mixed powder to flow out through an orifice having a diameter of 2.63 mm was measured, and the measured time was defined as the flow rate of the powder metallurgical mixed powder. On the basis of the determined particle size, flowability was evaluated according to the following criteria.

Evaluation Criteria:

A: Having a flow rate of less than 20 s/50 g at room temperature (25° C.);

B: Having a flow rate of from 20 s/50 g to less than 25 s/50 g at room temperature (25° C.); and C: Having a flow rate of 25 s/50 g or more at mom temperature (25° C.).

Graphite Scatter

Graphite scatter of a sample powder metallurgical mixed powder was measured using a graphite scattering rate measuring device as illustrated in FIG. 1. FIG. 1 is a schematic cross-sectional view of the graphite scattering rate measuring device used in the experimental examples. As illustrate in FIG. 1, the graphite scattering rate measuring device includes a funnel-like glass tube 2 (having an inside diameter of 16 mm and a height of 106 mm) equipped with a new Millipore filter 1 (having a mesh size of 12 μm). Into the graphite scattering rate measuring device, 25 g of the mixed powder P for powder metallurgy were charged, and a $N_2$ gas (at room temperature) was allowed to flow from below the glass tube 2 at a flow rate of 0.8 L/min for 20 minutes. The carbon amounts in the powder metallurgical mixed powder before and after the $N_2$ gas flow were measured. On the basis of the measured carbon amounts, the graphite scattering rate (%) was determined according to the following expression.

Graphite scattering rate (%)=[1−[(Carbon amount (mass percent) in powder metallurgical mixed powder after $N_2$ gas flow)/(Carbon amount (mass percent) in powder metallurgical mixed powder before $N_2$ gas flow)]]×100

The carbon amounts in each powder metallurgical mixed powder were determined by quantitatively analyzing the carbon contents. The graphite scatter was evaluated according to the following criteria Evaluation Criteria:

A: Having a graphite scattering rate of 0%; and

B: Having a graphite scattering rate of greater than 0% to 10%.

Ejection Pressure

A sample powder metallurgical mixed powder was compacted at a pressure of 10 t/cm$^2$ and room temperature (25° C.) using a die and yielded a cylindrical powder compact having a diameter of 25 mm and a length of 15 mm. A load necessary for the powder compact to be ejected from the die was measured. The measured load was divided by the contact area between the die and the powder compact, to give an ejection pressure. The ejection pressure was evaluated according to the following criteria.

Evaluation Criteria:

A: Having an ejection pressure of 20 MPa or less;

B: Having an ejection pressure of greater than 20 MPa to less than 25 MPa; and

C: Having an ejection pressure of 25 MPa or more.

Powder Compact Density

The density of the powder compact ejected from the die was measured in conformity to Japan Society of Powder and Powder Metallurgy (JSPM) standard 1-64 (Test Method of Compressibility of Metallic Powders). On the basis of this, the powder compact density was evaluated according to the following criteria.

Evaluation Criteria:

A: Having a powder compact density of 7.45 g/cm$^3$ or more;

B: Having a powder compact density of from 7.40 g/cm$^3$ to 7.45 g/cm$^3$; and

C: Having a powder compact density of less than 7.40 g/cm$^3$.

TABLE 2

| | Flowability | | Graphite scatter | | Ejection pressure | | Powder compact density | |
|---|---|---|---|---|---|---|---|---|
| | Flow rate (s/50 g) | Evaluation | Graphite scattering rate (%) | Evaluation | Ejection pressure (MPa) | Evaluation | Density (g/cm$^3$) | Evaluation |
| Example 1 | 23 | B | 0 | A | 22 | B | 7.45 | A |
| Example 2 | 23 | B | 0 | A | 22 | B | 7.45 | A |
| Example 3 | 23 | B | 0 | A | 22 | B | 7.45 | A |
| Example 4 | 23 | B | 0 | A | 22 | B | 7.45 | A |
| Example 5 | 23 | B | 0 | A | 15 | A | 7.40 | B |
| Example 6 | 23 | B | 0 | A | 17 | A | 7.42 | B |
| Example 7 | 23 | B | 0 | A | 20 | A | 7.43 | B |
| Example 8 | 23 | B | 0 | A | 20 | A | 7.44 | B |
| Example 9 | 18 | A | 0 | A | 22 | B | 7.45 | A |
| Example 10 | 18 | A | 0 | A | 22 | B | 7.45 | A |
| Example 11 | 18 | A | 0 | A | 22 | B | 7.45 | A |
| Example 12 | 18 | A | 0 | A | 22 | B | 7.45 | A |
| Example 13 | 18 | A | 0 | A | 22 | B | 7.45 | A |
| Example 14 | 18 | A | 0 | A | 22 | B | 7.45 | A |
| Example 15 | 18 | A | 0 | A | 22 | B | 7.45 | A |
| Comparative example 1 | 25 | C | 0 | A | 25 | C | 7.30 | C |
| Comparative example 2 | 25 | C | 0 | A | 25 | C | 7.30 | C |
| Comparative example 3 | 25 | C | 0 | A | 25 | C | 7.33 | C |
| Comparative example 4 | 25 | C | 0 | A | 25 | C | 7.33 | C |
| Comparative example 5 | 23 | B | 0 | A | 22 | B | 7.38 | C |

Evaluation Results

The results in Table 2 demonstrated that the powder compacts according to Examples 1 to 15 have higher densities as compared with the powder compacts according to Comparative Examples 1 to 5. The results also demonstrated that the powder metallurgical mixed powders according to Examples 9 to 15, which employ, as the binder, a polyolefin and/or an acrylic resin offer better flowability as compared with powder metallurgical mixed powder according to the other examples and the comparative examples. The results also demonstrated that the powder metallurgical mixed powders according to Examples 5 to 8, which employ an amide compound as the lubricant, require lower ejection pressures as compared with powder metallurgical mixed powders according to the other examples and the comparative examples.

This application claims priority to (is based on) Japanese Patent Application No. 2014-266266, filed Dec. 26, 2014, the entire contents of which are incorporated herein by reference.

To illustrate the present invention, the present invention has been appropriately and sufficiently described above in its embodiments with reference to the accompanying drawings. However, it is to be recognized that those skilled in the art could easily reach various variations and/or improvements of the abovementioned embodiments. Accordingly, it is to be understood that various modifications and improvements made by those skilled in the art will fall within the scope of the present invention as set forth in the appended claims, without departing from the spirit and scope of the present invention as set forth in the appended claims.

INDUSTRIAL APPLICABILITY

As has been described above, the lubricant, the powder metallurgical mixed powder, and the sintered compact production method according to the present invention are suitable for the production of a sintered compact that has a high density and high quality.

The invention claimed is:

1. A metallurgical mixed powder, comprising:

an iron-based powder;

a lubricant; and a binder, wherein the lubricant comprises:

a flaky organic material having an average particle diameter of from 0.1 μm to less than 3 μm, wherein the flaky organic material comprises melamine cyanurate, and the binder comprises at least one component selected from the group consisting of:

a polyolefin having a melting point of 45° C. to 90° C. and a melt flow rate at 190° C. of 2.8 g/10 min. to 3.8 g/10 min.; and an acrylic resin having a weight-average molecular weight of $50\times10^4$ or less.

2. The metallurgical mixed powder according to claim 1, wherein the binder comprises both the polyolefin and the acrylic resin, and wherein the binder comprises the acrylic resin in a content of 10 parts by mass or more per 100 parts by mass of the polyolefin.

3. The metallurgical mixed powder according to claim 1, further comprising an auxiliary material powder.

4. The metallurgical mixed powder according to claim 3, wherein the auxiliary material powder comprises graphite.

5. The metallurgical mixed powder according to claim 1, wherein the flaky organic material has substantially no melting point.

6. The metallurgical mixed powder according to claim 1, wherein the lubricant further comprises an amide compound in a content of 10 parts by mass to 90 parts by mass per 100 parts by mass of the flaky organic material.

7. The metallurgical mixed powder according to claim 1, wherein the flaky organic material has undergone at least one surface treatment selected from the group consisting of: a silicone treatment and a fatty acid treatment.

8. A method for producing a sintered compact, the method comprising: mixing materials to obtain the metallurgical mixed powder according to claim 1; compacting the metallurgical mixed powder using a die to obtain a powder compact; and sintering the powder compact to obtain a sintered compact.

9. The method according to claim 8, wherein the mixing comprises mixing materials comprising:

the iron-based powder;

the lubricant; and an auxiliary material powder.

10. The method according to claim 9, wherein the auxiliary material powder comprises graphite.

* * * * *